US009320406B2

(12) United States Patent
Irwin et al.

(10) Patent No.: US 9,320,406 B2
(45) Date of Patent: Apr. 26, 2016

(54) BUCKETLESS HANDLE

(71) Applicant: Impact Products, LLC, Toledo, OH (US)

(72) Inventors: John T. Irwin, Sylvania, OH (US); Jeffrey C. Gayer, Sylvania, OH (US); Stephen A. Dukes, North Baltimore, OH (US)

(73) Assignee: Impact Products, LLC, Toledo, OH (US)

( * ) Notice: Subject to any disclaimer, the term of this patent is extended or adjusted under 35 U.S.C. 154(b) by 442 days.

(21) Appl. No.: 13/827,232

(22) Filed: Mar. 14, 2013

(65) Prior Publication Data

US 2013/0263398 A1 Oct. 10, 2013

Related U.S. Application Data

(60) Provisional application No. 61/620,626, filed on Apr. 5, 2012, provisional application No. 61/635,474, filed on Apr. 19, 2012.

(51) Int. Cl.
*A47L 13/22* (2006.01)
*A47L 13/26* (2006.01)

(52) U.S. Cl.
CPC . *A47L 13/22* (2013.01); *A47L 13/26* (2013.01)

(58) Field of Classification Search
CPC ..... A47L 13/22; A47L 13/26
USPC ..... 401/44–47, 137–140, 289
See application file for complete search history.

(56) References Cited

U.S. PATENT DOCUMENTS

| | | | | |
|---|---|---|---|---|
| 2,053,282 | A | 9/1936 | Gewalt | |
| 4,191,311 | A | 3/1980 | Auguadro | |
| 5,865,551 | A | 2/1999 | Lalli et al. | |
| 6,017,163 | A * | 1/2000 | Keppers et al. | 401/48 |
| 6,227,744 | B1 * | 5/2001 | Fodrocy | A47L 13/22 401/137 |
| 6,551,001 | B2 | 4/2003 | Aberegg et al. | |
| 7,163,349 | B2 | 1/2007 | Policicchio et al. | |
| 7,441,301 | B2 | 10/2008 | Kresse et al. | |
| 7,740,412 | B2 | 6/2010 | Hoadley et al. | |
| 2003/0209263 | A1 | 11/2003 | Bell et al. | |
| 2004/0231700 | A1 | 11/2004 | Bell et al. | |
| 2007/0177925 | A1 | 8/2007 | Perelli | |
| 2008/0063460 | A1 * | 3/2008 | Balz et al. | 401/138 |
| 2008/0107471 | A1 * | 5/2008 | Fitzpatrick et al. | 401/138 |

* cited by examiner

*Primary Examiner* — Jennifer C Chiang
*Assistant Examiner* — Bradley Oliver
(74) *Attorney, Agent, or Firm* — Fraser Clemens Martin & Miller LLC; James D. Miller

(57) ABSTRACT

A modular cleaning device including a handle assembly having a container, a dispensing element in fluid communication with the container, and a cleaning element. A backpack including a bladder in fluid communication with the dispensing element is also included. The handle assembly is configured to dispense a fluid from at least one of the backpack and the container.

14 Claims, 11 Drawing Sheets

BUCKETLESS HANDLE

CROSS-REFERENCE TO RELATED APPLICATIONS

This application claims priority to U.S. Provisional Patent Application Ser. Nos. 61/620,626, filed Apr. 5, 2012, and 61/635,474, filed Apr. 19, 2012, the entire disclosures of which is hereby incorporated herein by reference.

FIELD OF THE INVENTION

The present disclosure relates to a bucketless handle coupled to a cleaning element, and more specifically to a bucketless handle coupled to a cleaning element that may be used independently or with a user-wearable backpack.

BACKGROUND OF THE INVENTION

Advancements continue to be made in cleaning devices adapted to dispense fluid onto one or more surfaces in relation to wiping, scrubbing, mopping, finishing, or other operations performed by the cleaning devices. Examples of such cleaning devices include mops, dusters, finishers, and similar tools. Such cleaning devices and finish application tools can incorporate an attached container or a remote reservoir design for holding a liquid such as water, disinfectant, finishers, and/or other solution.

In many cases, the cleaning devices are expensive and are configured only for use with a single accessory. Accordingly, such devices can require a distributor to stock one particular item for use with the cleaning device, such as an exclusive floor finish formula and corresponding container. These devices are typically not utilized for any other activity and often become an underutilized capital investment once a cleaning or refinishing task is complete. Likewise, the cleaning devices are typically not appropriate for a variety of cleaning tasks and are only useful under limited circumstances. While such cleaning devices are often suitable for their intended uses, they are often inconvenient for a user. Further advancements in this technology are always welcome in the art.

It is desirable to have a cleaning device that is capable of cleaning and treating a variety of surfaces using various solutions, interchangeable between an independent cleaning device and a cleaning device connected to a remote reservoir, and convenient to use.

SUMMARY OF THE INVENTION

Consonant with the present disclosure, a cleaning device that is capable of cleaning and treating a variety of surfaces using various solutions, interchangeable between an independent cleaning device and a cleaning device connected to a remote reservoir, and convenient to use, has surprisingly been discovered.

In one embodiment of the disclosure, a modular cleaning device is disclosed. The cleaning device includes a handle assembly having a container, a dispensing element in fluid communication with the container, a cleaning element, and a backpack including a bladder in fluid communication with the dispensing element. The handle assembly is configured to selectively dispense a fluid from at least one of the backpack and the container.

In another embodiment of the disclosure, a modular cleaning device is disclosed including a handle having an actuator disposed at a first end and a frame removeably connected to a second end. The cleaning device also includes a dispensing element configured to selectively dispense fluid from a user-wearable backpack and a container disposed on the handle, and a cleaning element removeably connected to the frame.

In yet another embodiment of the disclosure, a modular cleaning device is disclosed. The cleaning device includes a bladder disposed in a backpack, a conduit providing fluid communication between the bladder and a dispensing element, and a belt removeably attached to the backpack for encircling a waist of a user.

DRAWINGS

The above, as well as other advantages of the present disclosure, will become readily apparent to those skilled in the art from the following detailed description, particularly when considered in the light of the drawings described hereafter. The drawings described herein are for illustrative purposes only and are not intended to limit the scope of the present disclosure.

DETAILED DESCRIPTION OF EXEMPLARY EMBODIMENTS OF THE INVENTION

The following detailed description and appended drawings describe and illustrate various exemplary embodiments of the invention. The description and drawings serve to enable one skilled in the art to make and use the invention, and are not intended to limit the present disclosure, application, or uses.

Figure 1:
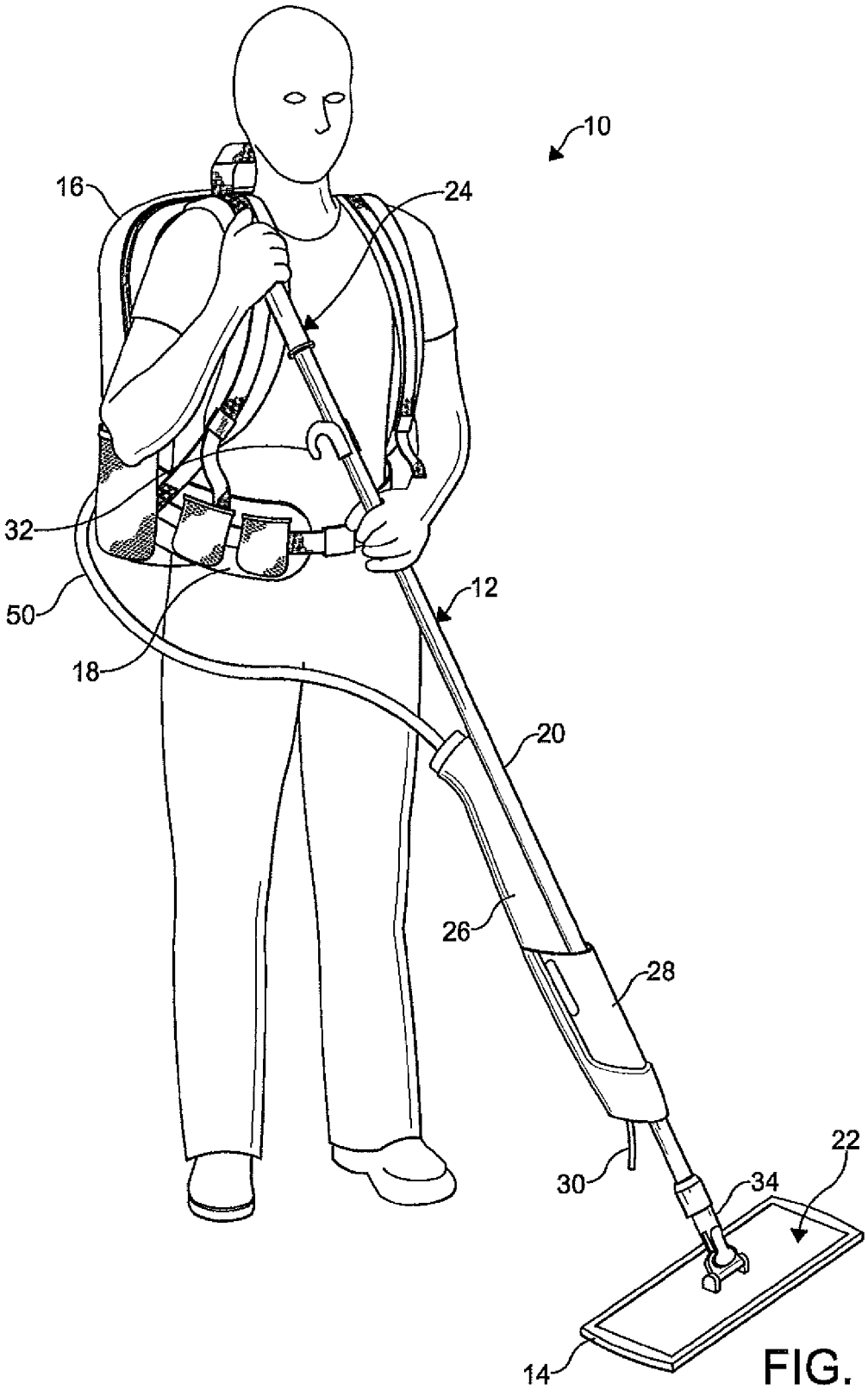
FIG. 1 is a perspective view of a cleaning device including a handle assembly, a backpack, and a belt according to one embodiment of the disclosure.
Figure 2:
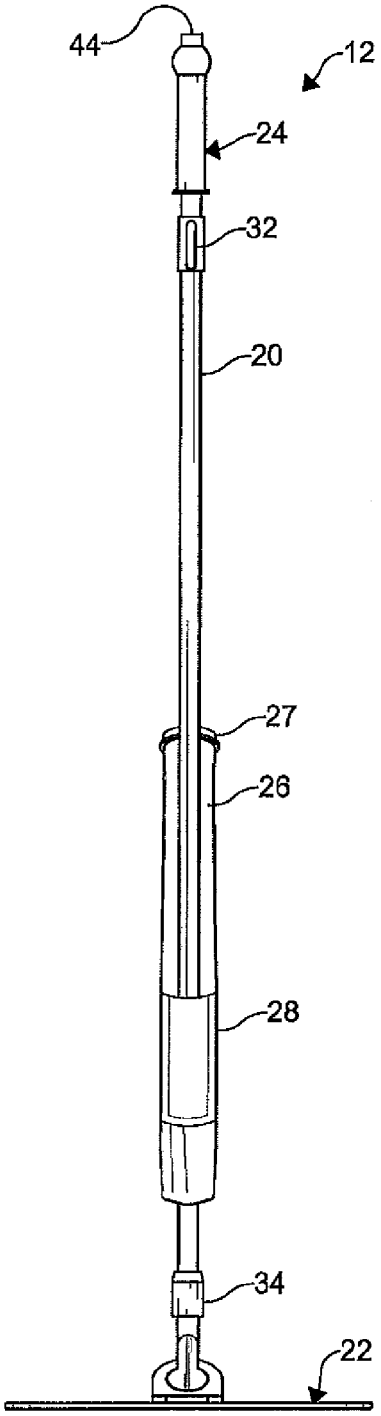
FIG. 2 is a front elevational view of the handle assembly of the cleaning device of FIG. 1.
Figure 3:
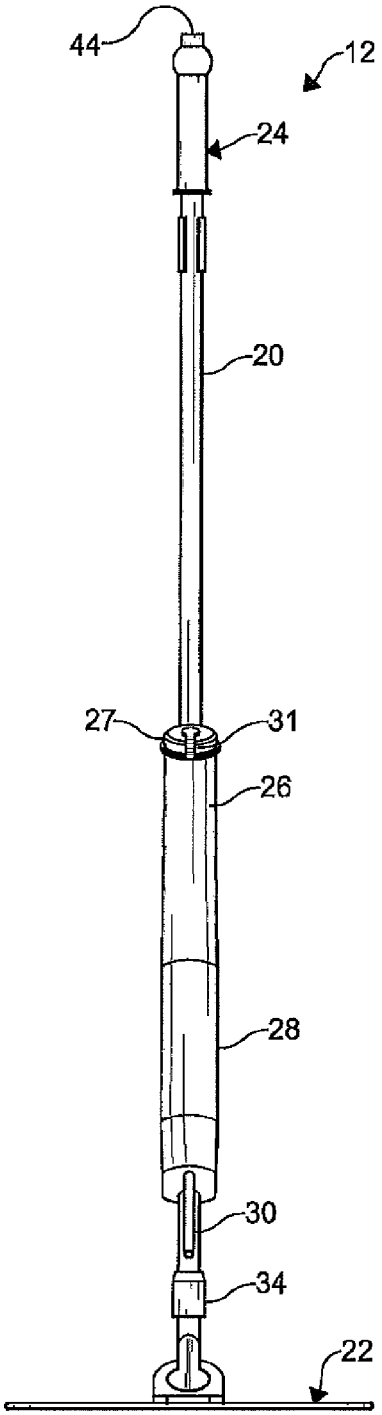
FIG. 3 is a rear elevational view of the handle assembly of the cleaning device of FIG. 1.
Figure 4:
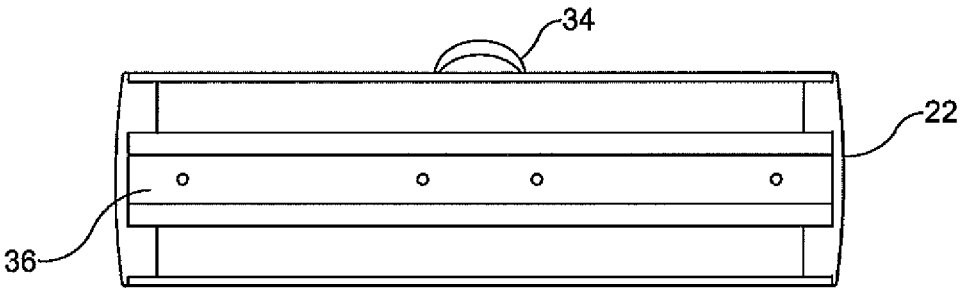
FIG. 4 is a bottom plan view of a frame of the handle assembly of FIG. 1.

FIG. 1 illustrates a cleaning device 10 according to one embodiment of the disclosure. The cleaning device 10 includes a bucketless handle assembly 12 coupled to a removable cleaning element 14 and removeably attached to a user-wearable backpack 16 and belt 18. The cleaning device 10 may be used with interchangeable cleaning elements 14 and various types and volumes of cleaning solutions. Alternatively, as will be further described herein below, the cleaning element 14 and the bucketless handle assembly 12 may be used independently from the backpack 16 and belt 18.

The bucketless handle assembly 12, as more clearly shown in FIGS. 2-8, includes a handle portion 20 and a frame 22. The handle portion 20 is typically rigid, elongate, and substantially cylindrical and may be made from metal, plastic, or any other light weight material that may be easily gripped by the user. The handle portion 20 has a first end and a second end. An actuator 24 is disposed at the first end of the handle portion 20 and the frame 22 is removeably connected to the second end of the handle portion 20. A dispensing container 26 is disposed in a container support 28 that may be permanently or removeably connected to the handle portion 20 intermediate the first end and the second end. The container support 28 also includes a dispensing element 30 in fluid communication with the dispensing container 26 for dispensing the solution in front of, behind, or onto the cleaning element 14 of the cleaning device 10 when in use. A hook 32 or other device used for hanging the handle assembly 12 may also be attached to the handle portion 20 intermediate the first end and the second end. The hook 32 and the container support 28 may be made from any light weight and durable material such as plastic, for example. At least a portion of the dispensing container 26 and the dispensing element 30 are typically made from a translucent material such as plastic, for example, that is capable of containing the liquid or gel solution.

The frame 22 includes a coupling device 34 and a receiving member 36. The coupling device 34 is typically cylindrical and hollow. The second end of the handle portion 20 may be inserted into a first end of the coupling device 34. In certain embodiments of the disclosure, the second end of the handle portion 20 and a first end of the coupling device 34 may include openings 38 that have a corresponding shape and size as more clearly shown in FIGS. 6A and 6B. Upon alignment of the openings 38, a securing element 40 may be positioned by the user to extend through each of the openings 38 in order to secure the handle portion 20 to the coupling device 34. Other means for removeably connecting the frame 22 and the handle portion 20 may be used, as desired. For example, the coupling device 34 may include male protrusions 42 for insertion into the openings 38 included on the handle portion 20, or vice versa. The frame 22 may be interchangeable with additional frames 22 having varying shapes, sizes, and cleaning purposes. Accordingly, the user can use one handle portion 20 with many different frames 22 to perform numerous cleaning jobs.

The receiving member 36 is attached to the frame 22 adjacent a second end of the coupling device 34. The receiving member 36 is typically thin and planar and may be made from any lightweight and resilient material such as plastic, for example. The receiving member 36 may be any shape, as desired. The cleaning element 14 is removeably connected to the receiving member 36 of the frame 22 using any means such as a friction fit, hook and loop fastener, elastic, or any other mechanical fastener. A variety of cleaning elements 14 may be employed, such as those adapted for dusting, damp mopping, deep cleaning, disposable heads, floor finish applications, staining applications, and use on concrete, for example.

The dispensing container 26 is typically made from a material such as plastic, for example, and includes a first removable cap 27 at a first end of the dispensing container 26 and second removable cap 29 at a second end of the dispensing container 26 allowing for easy rinsing and cleaning of the dispensing container 26 when both caps 27, 29 are removed. The first end of the dispensing container 26 may have a larger diameter to allow for easy pouring of the solution contents into and out of the dispensing container 26. The second end of the dispensing container 26 including the cap 29 may be directly connected to or in fluid communication with the dispensing element 30. The dispensing container 26 may be easily removed and replaced in the container support 28 by alternative dispensing containers 26 allowing different solutions such as cleaner, disinfectant, finisher, etc. to be quickly and easily interchanged within one cleaning device 10. Accordingly, the user may remove one dispensing container 26 and replace it with another in order to perform various cleaning tasks. In certain embodiments, the dispensing container 26 may only be able to dispense the solution when properly positioned in the container support 28.

At least one of the removable caps 27, 29 may have a tethered portion including a loop 31 or similar feature that allows the dispensing container 26 to be suspended from a hook located on a wall, independent docking station, or another location that is independent of the cleaning device 10 when the dispensing container 26 is not in use. This allows for easy storage and organization of many dispensing containers 26 containing various cleaning solutions. The dispensing container 26 may be transparent or translucent or have a transparent or translucent strip, include one or more labels, and can also include graduated indicia that identify the fill level of the contents of the dispensing container 26. The dispensing container 26 may have a groove in the portion adjacent the handle portion 20 in order to stabilize and secure the dispensing container 26 against the handle portion 20.

Figure 5:
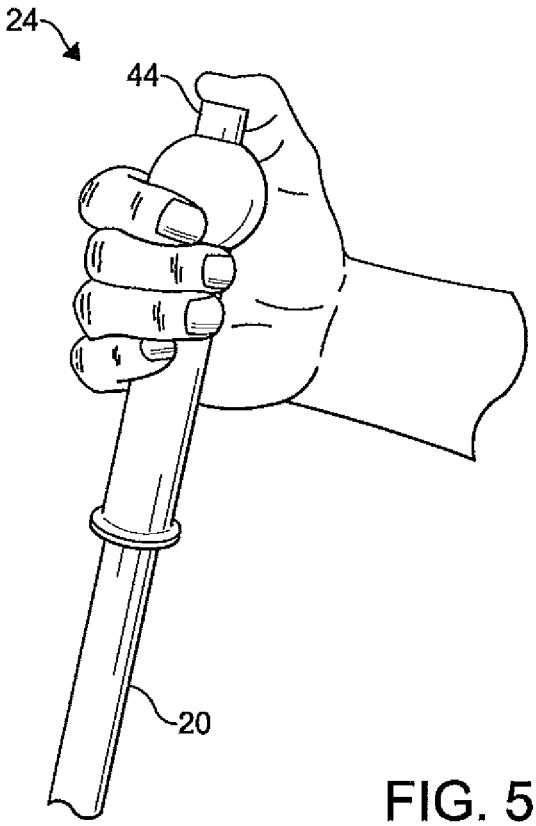
FIG. 5 is a fragmentary perspective view of a push-button actuator of the handle assembly of FIG. 1.
Figure 6A:
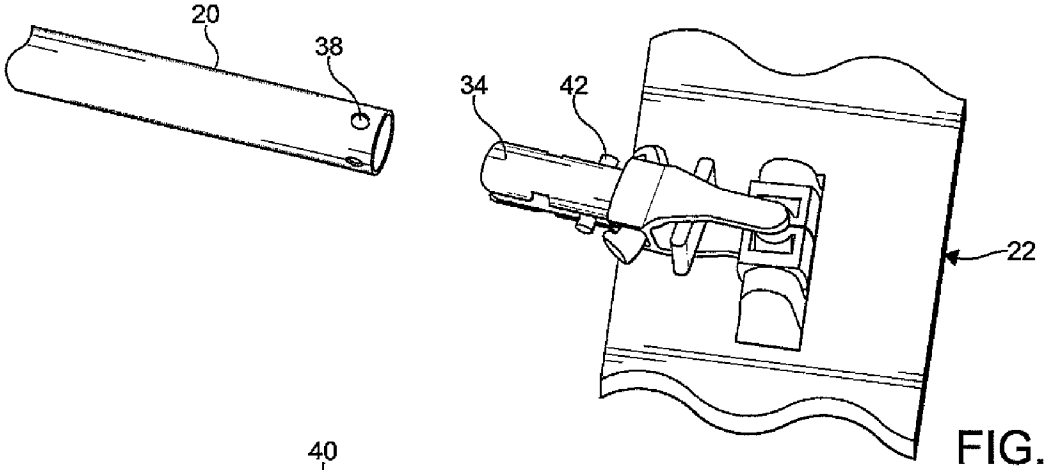
FIG. 6A is a partially exploded fragmentary perspective view of a frame of the handle assembly of FIG. 1.
Figure 6B:
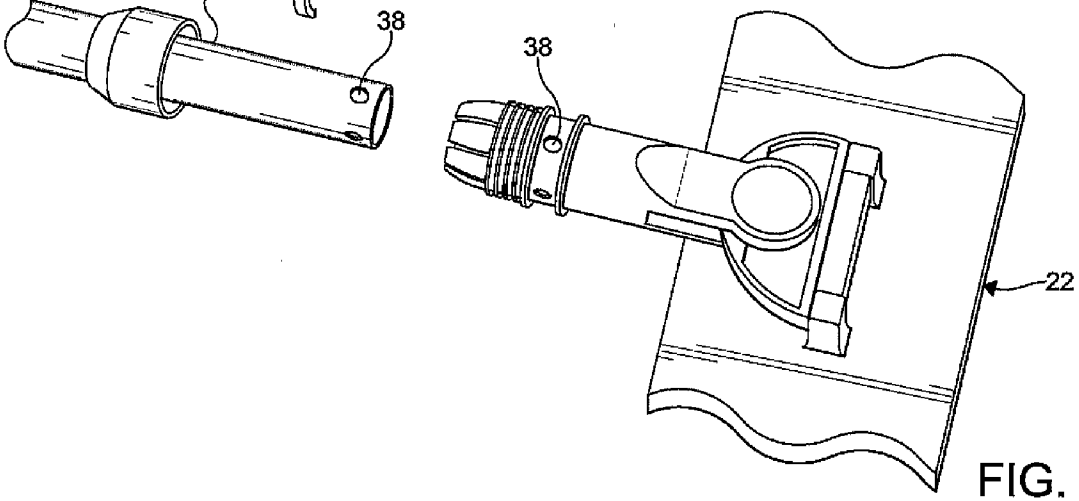
FIG. 6B is a partially exploded fragmentary perspective view of a frame according to another embodiment of the handle assembly of FIG. 1.
Figure 7:
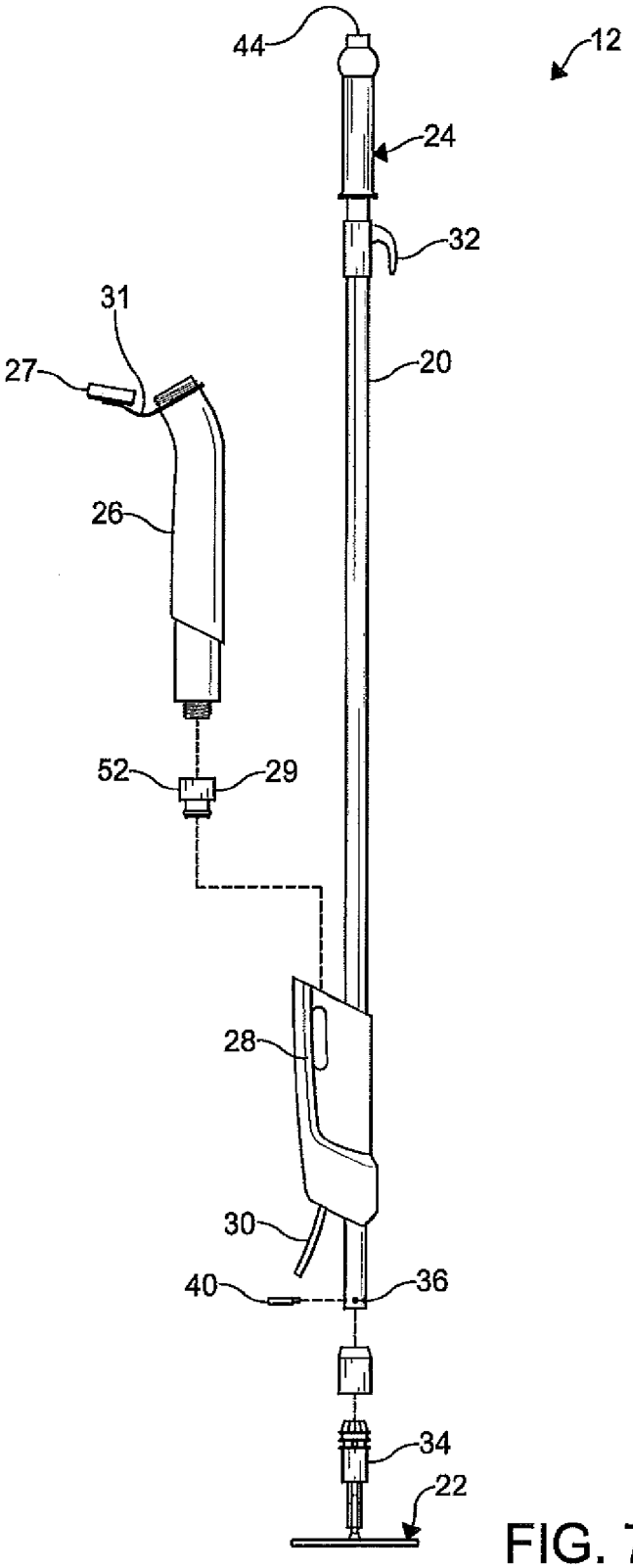
FIG. 7 is a partially exploded view of the handle assembly of FIG. 1.
Figure 8:
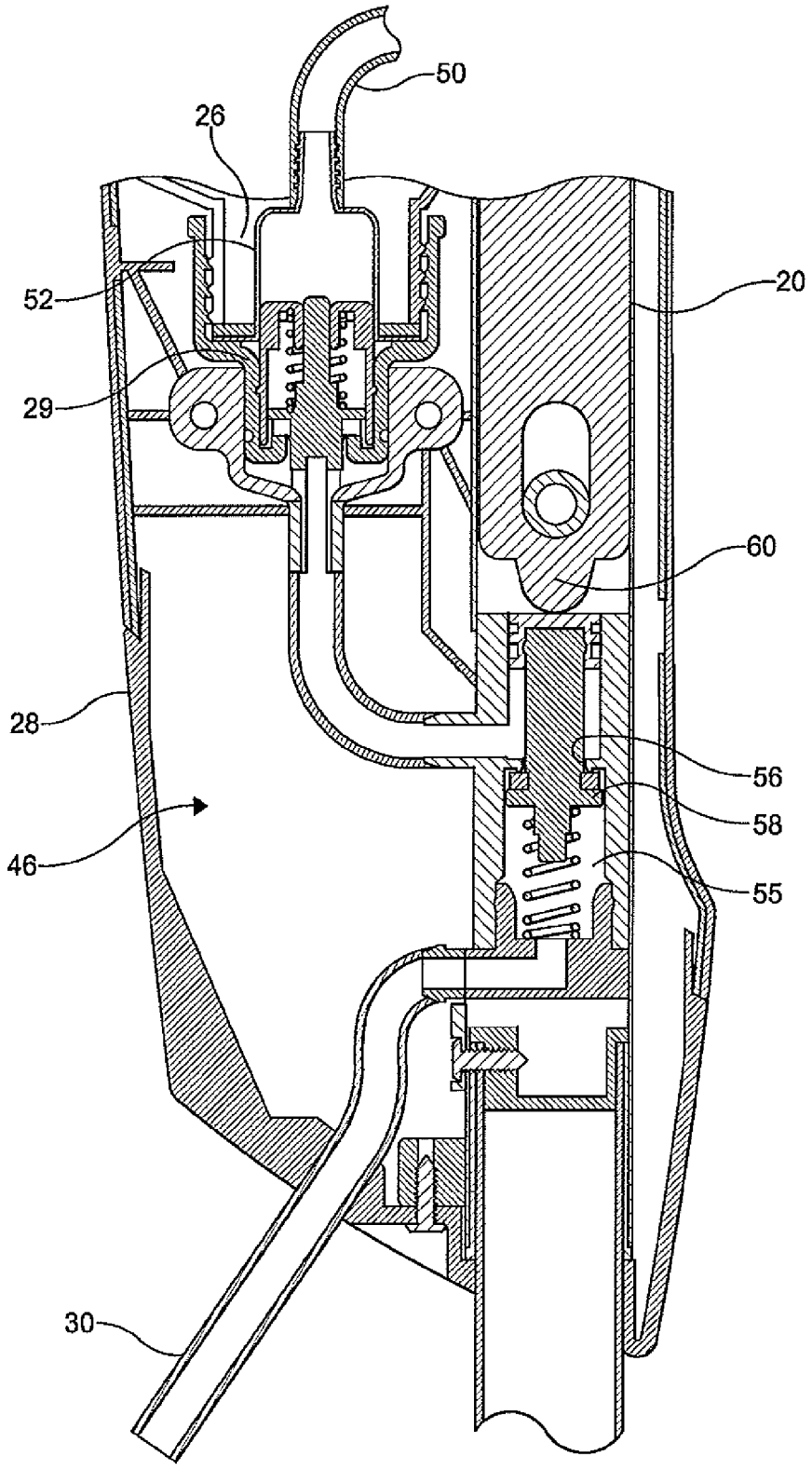
FIG. 8 is a fragmentary cross-sectional view of a fluid dispensing system of the handle assembly of FIG. 1.
Figure 10:
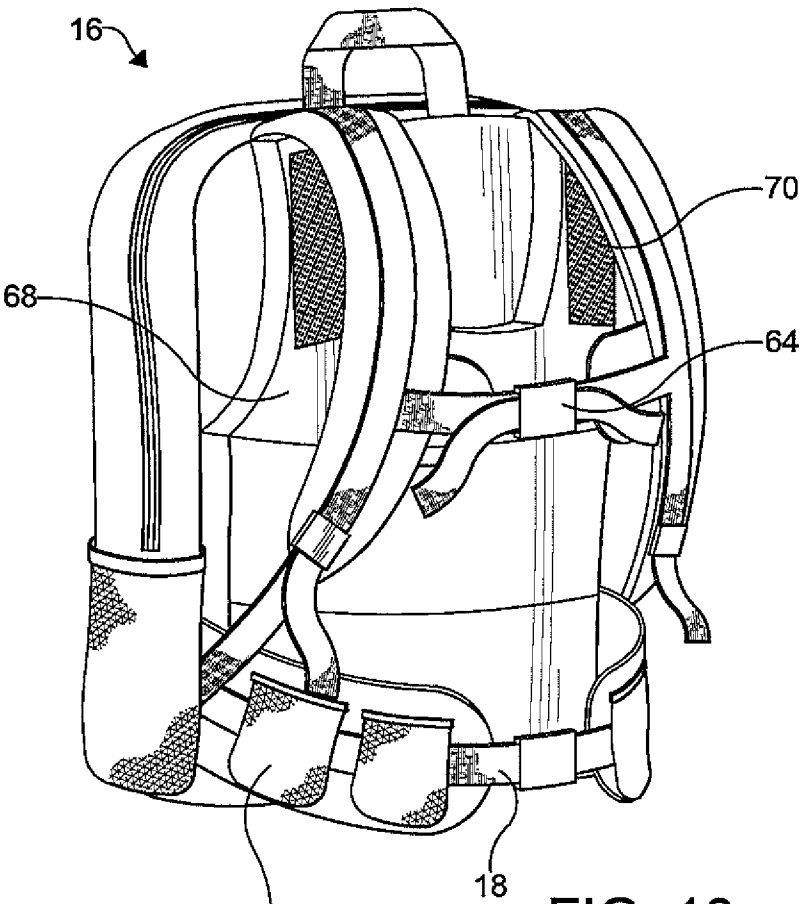
FIG. 10 is a front perspective view of the backpack of FIG. 1.

As clearly shown in FIG. 5, the actuator 24 includes a push-button 44 disposed on the first end of the handle portion 20 that actuates a system 46 for releasing the solution housed in the dispensing container 26. The system 46, as illustrated in FIG. 8, utilizes a gravity feed and includes a valve 58 that prevents the contents of the dispensing container 26 from exiting through the dispensing element 30 until a linear actuation thereof. The user can release the contents of the dispensing container 26 by depressing the push-button 44 on the handle portion 20 which actuates a rod 60 similar to that found in a ball point pen. The rod 60 urges the valve 58 into a chamber 55 away from an opening 56. By pressing the push-button 44 located on the handle portion 20, the system 46 moves to a lock-on position and the solution can exit the dispensing container 26 and travel through the opening 56 in the handle portion 20 and out the dispensing element 30. The solution can continue to exit the dispensing container 26 until the push-button 44 is pressed again, thereby closing the valve 58 and preventing the solution from flowing through the opening 56 and exiting the dispensing container 26. The valve 58 may be a cartridge valve that is flooded with the solution from the dispensing container 26 at an inlet in certain embodiments of the disclosure.

The system 46 for releasing the solution in the dispensing container 26 can include a sprayer option wherein when the system 46 is locked on, the solution is pumped to the frame 22 or the dispensing element 30. In some embodiments, the dispensing container 26 can be pressurized where a propellant such as pressurized air forces liquid out of the dispensing container 26 when the push-button 44 on the handle portion 20 actuates the system 46. Other embodiments may include a pre-packaged, single use dispensing container 26 for use with the cleaning device 10.

Figure 11:
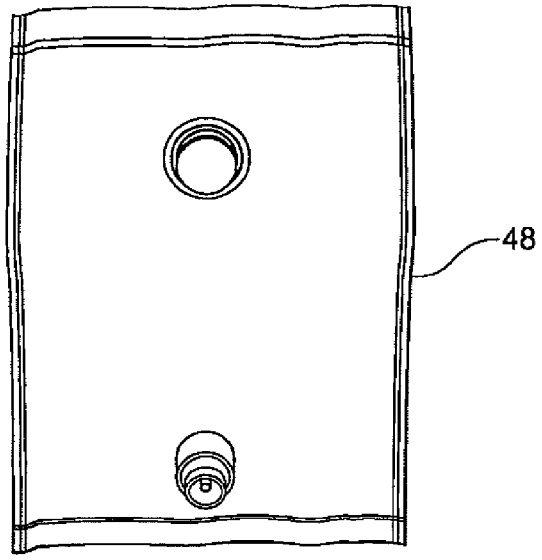
FIG. 11 is a front perspective view of a bladder of the backpack shown in FIG. 1.
Figure 12:
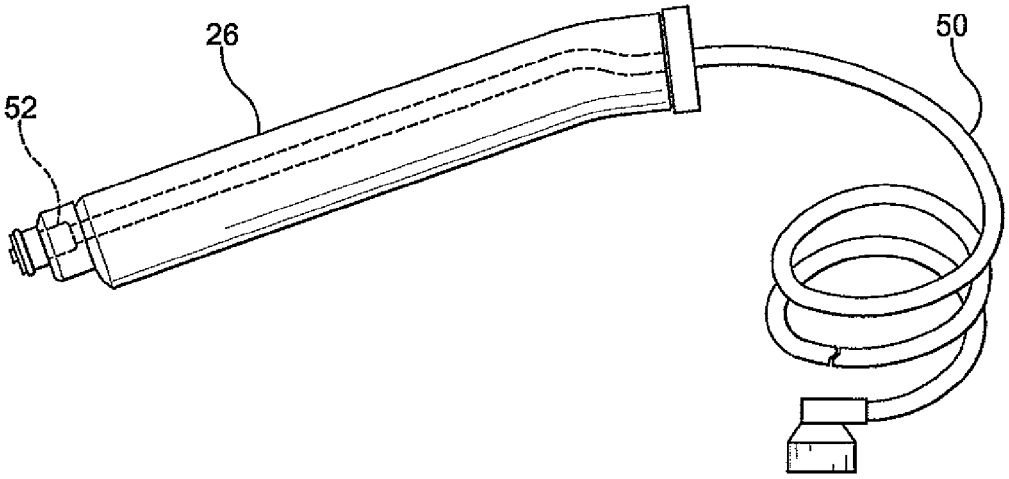
FIG. 12 is a side perspective view of a tubing and a container of the cleaning device shown in FIG. 1.

The handle portion 20 may be connected to the user-wearable backpack 16 in certain embodiments. The backpack 16, as shown in FIGS. 1, 9, 10, and 16, includes a reservoir or bladder 48 disposed in the backpack that may be filled and refilled from any 1 gallon bottle, 5 gallon pail, 55 gallon drum, or other container to hold any type of floor disinfectant, cleaner, or finish (see FIG. 11). The bladder 48 may be removeably connected to the dispensing container 26 using a conduit or tube 50 in order to supply the solution to the dispensing container 26 (see FIG. 12). The solution then passes through the dispensing container 26 and out the dispensing element 30, as described hereinabove. Alternatively, the bladder 48 may be coupled to the handle portion 20 or a portion thereof directly in place of the dispensing container 26. An adapter element 52 may be disposed at one end of the dispensing container 26 or at one end of the tube 50 allowing the actuator 24 to work even when the solution originates from the bladder 48, rather than the dispensing container 26. Specifically, the tube 50 may extend from the bladder 48 and through the dispensing container 26, bypassing the solution contained in the dispensing container 26, or the dispensing container 26 can be eliminated. The tube 50 connects to the adapter 52 such that when the valve 58 is opened by activating the push-button 44, solution from the bladder 48 continuously exits the bladder 48 as it would from the dispensing container 26. In certain embodiments, as shown in FIG. 8, the adaptor 52 may be an insert removeably connected to the tube 50 that is positioned and secured between the dispensing container 26 and the cap 29 when the cap 29 is threaded onto the dispensing container 26. The adaptor 52 may also be integrally formed with the cap 29 in certain embodiments of the disclosure.

Figure 9:
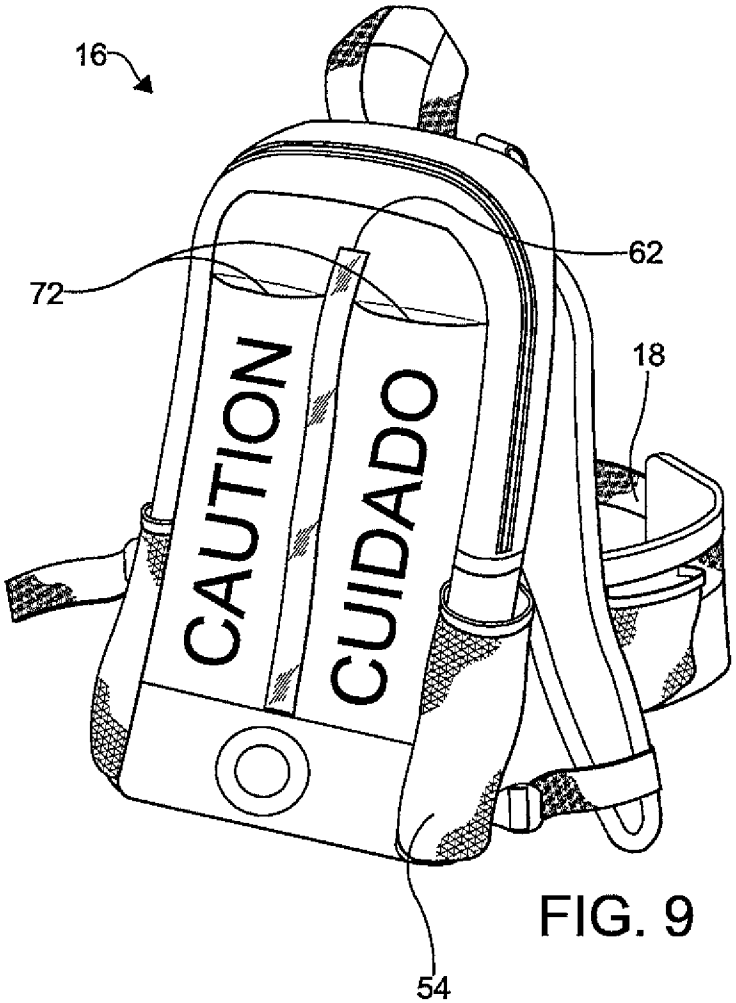
FIG. 9 is a rear perspective view of the backpack of FIG. 1.
Figure 14:
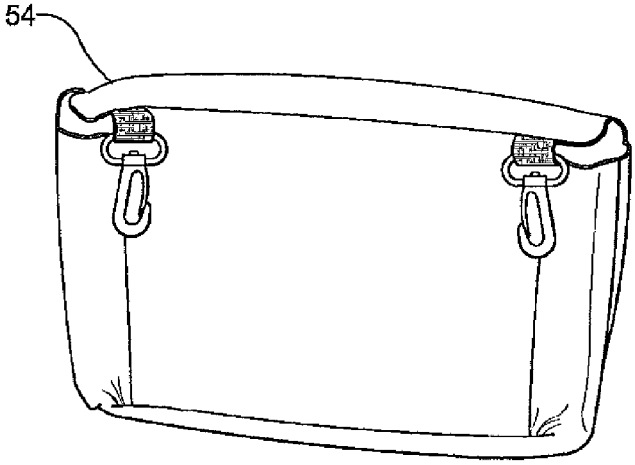
FIG. 14 is a perspective view of a compartment of the belt shown in FIG. 1.
Figure 15:
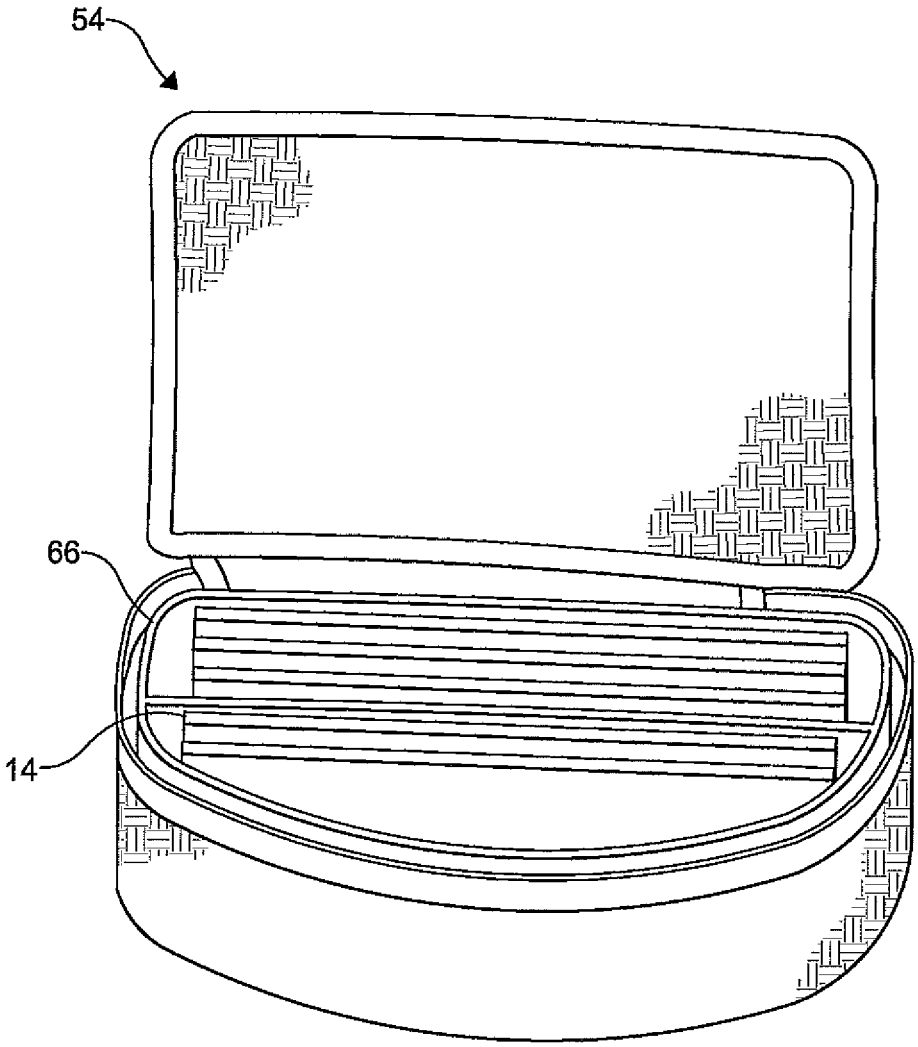
FIG. 15 is a perspective view of a compartment of the belt of FIG. 1 including cleaning elements.
Figure 16:
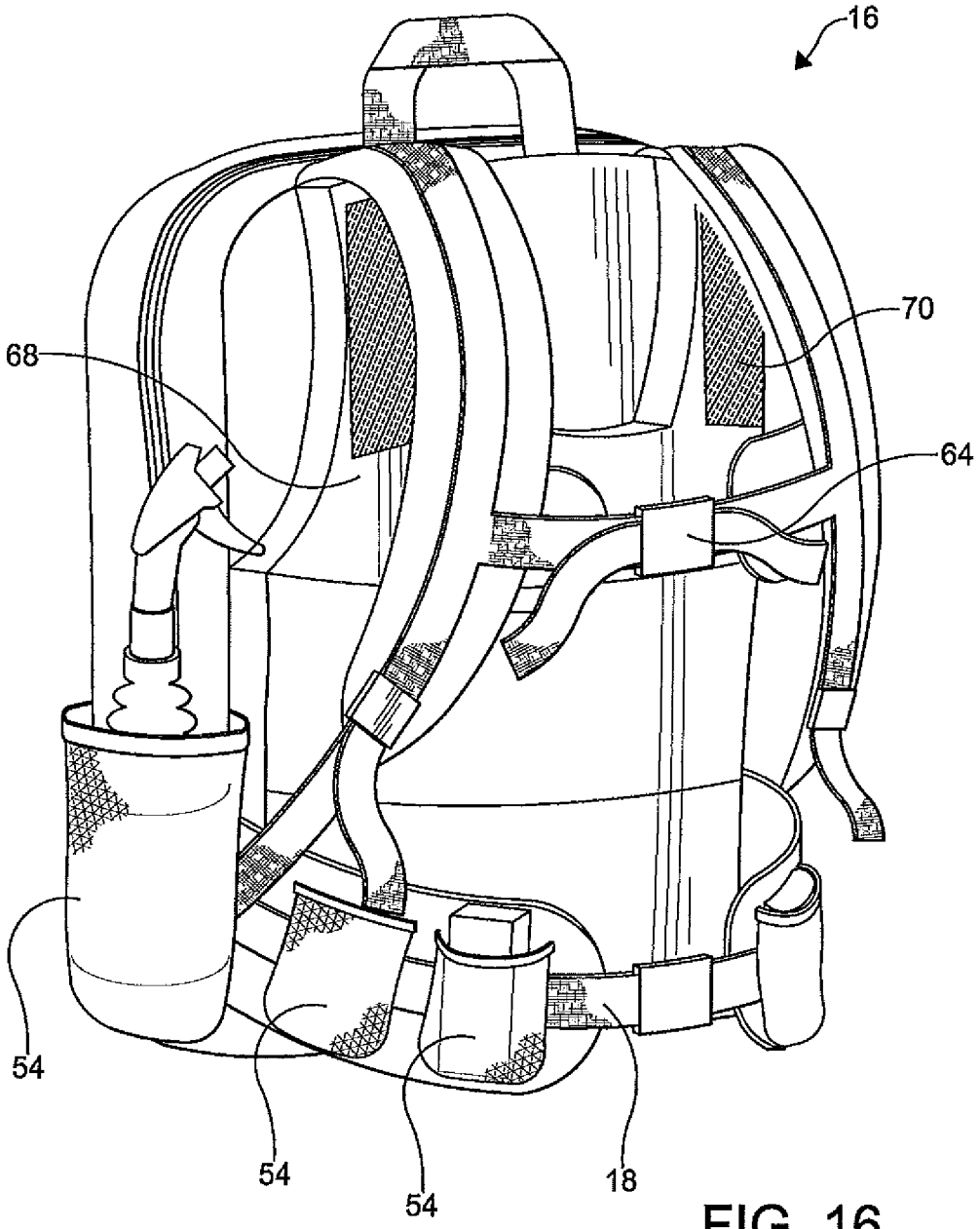
FIG. 16 is a front perspective view of the backpack and belt shown in FIG. 1.

The backpack 16 may include various additional features. For example, an adjustable sternum strap 64 may be connected to one or more straps on the backpack 16 (see FIGS. 9 and 16). Additionally, one or more pads 68 and/or vents 70 may be included on a front portion of the backpack 16. As shown in FIG. 9, a rear portion of the backpack may include one or more pockets 72 including warning or caution labels on an outer surface of the pockets and capable of storing additional warning or caution signage, for example. The caution labels on the rear portion of the back pack 16 may be important when the user is walking backwards while mopping a floor. Additionally, a viewing window 62 may be included on the rear portion of the backpack allowing a user to see if the bladder 48 is full of solution or empty. Compartments 54 may also be provided for holding Material Safety Data Sheet (MSDS) and/or Safety Data Sheet (SDS) information and additional collapsible signage (e.g., freestanding "wet floor" or "caution" signs). Compartments 54 for holding replacement cleaning elements 14 for attaching to the frame 22 or other cleaning pads or materials may also be included on the backpack 16 (see FIG. 14). One of more of the compartments 54 may include a waterproof, removeable compartment liner 66 including one of more dividing elements so that both unused and used cleaning elements may be stored separately (see FIG. 15). A bag liner may also be incorporated into the backpack 16 where the bladder 48 is disposed. The backpack 16 may be configured to hold and/or dispense other accessories such as protective eyewear, shoe covers, disposable gloves, hand sanitizer, black pads, masking tape, a putty knife, and a two-way radio, for example. Reflective material and/or highly visible colors may also be incorporated into the backpack 16. Additional dispensing containers 26 may also be held by the backpack 16.

Figure 13:
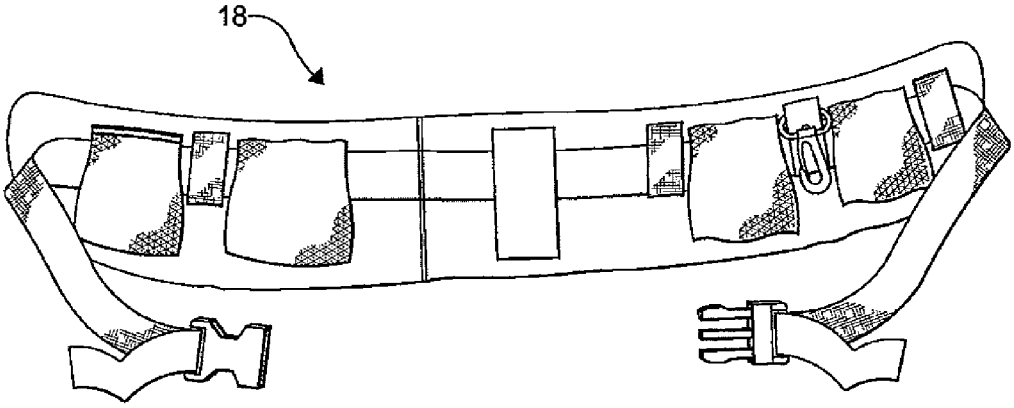
FIG. 13 is a perspective view of the belt of FIG. 1.

The belt 18, as shown in FIG. 13, is typically removeably connected to the backpack 16 and may be used to further secure and stabilize the backpack 16 on the user. A buckle or tie mechanism may be included on the belt 18 to enclose the belt 18 around a waist of the user. The belt 18 may also include warning or descriptive signage held in compartments 54 with windows or attached to the belt 18. Compartments 54 for holding replacement cleaning elements 14 for attaching to the frame 22 or other cleaning pads or materials may also be included. A bag liner may be incorporated into the belt 18 to hold used cleaning elements 14. Similar to the backpack 16, the belt 18 may be configured to hold and/or dispense other accessories such as protective eyewear, shoe covers, disposable gloves, hand sanitizer, black pads, masking tape, a putty knife, and a two-way radio, for example. Reflective material and/or highly visible colors may also be incorporated into the belt 18.

In use, the user will evaluate the task to be performed. For illustrative purposes, the user may determine that a small floor surface needs to be disinfected. Accordingly, the user will select a disinfectant solution and an appropriate cleaning element 14. The user will position the cleaning element 14 on the frame 22 and pour the appropriate solution into the dispensing container 26. Alternatively, the user may simply select a dispensing container 26 already containing the appropriate solution and position the dispensing container 26 in the container support 28. To actuate the handle assembly 12, the user will depress the push-button 44 thereby activating the system 46, opening the valve 58, and permitting the solution to flow from the dispensing container 26, through the opening 56 in the handle portion 20, and out of the dispensing element 30. Once the user determines that an adequate amount of solution has been released from the dispensing container 26, the user presses the push-button 44 again to disengage the system 46 and close the valve 58. The user may repeat activation of the system 46 as needed. Alternate cleaning elements 14 and/or solutions may be selected for various tasks. The handle assembly 12 and the dispensing container 26 may be easily stored using the hook 32 and the loop 31, respectively.

It is possible that the user may determine that a large or remote floor surface needs to be disinfected. Accordingly, the user will select a disinfectant solution and an appropriate cleaning element 14. The user will position the cleaning element 14 on the frame 22 and pour the appropriate solution into the bladder 48. The user may then connect the tube 50 to both the bladder 48 and the adaptor 52 in order to create a fluid path from the bladder 48 to the handle assembly 12 for the solution. To actuate the cleaning device 10, the user will depress the push-button 44 to activate the system 46 and open the valve 58, permitting the solution to flow from the bladder 48, through the opening 56 in the handle portion 20, and out the dispensing element 30. Once the user determines that an adequate amount of solution has been released, the user presses the push-button 44 again to disengage the system 46. The user may repeat activation of the system 46 as needed. Alternate cleaning elements 14 and/or solutions may be selected for various tasks. Additionally, the user may access new cleaning elements 14 and other required items relating to safety and performance of the tasks, and store items such as used cleaning elements 14 on the backpack 16 and/or the belt 18. The handle assembly 12 and the backpack 16 may be easily stored using the hook 32 and a loop included on the backpack, respectively.

The cleaning device 10 may be used for large and small projects alike as a result of to the interchangeability between the stand-alone handle assembly 12 and the combined handle assembly 12 and backpack 16 cleaning device 10. The lightweight and simple handle assembly 12 makes cleaning in small, difficult to reach places easy and efficient. The agile maneuverability, portability, and large reservoir capacity of the cleaning device 10 including the backpack 16 allows the cleaning device 10 to be employed by floor care professionals in schools, acute care, long term care, health & fitness, food service, dental, big box retail, hospitality, entertainment, salon, office, and convenience store environments, among others. Additionally, the interchangeability between the various dispensing containers 26, frames 22, and cleaning elements 14 allows the cleaning device 10 to be used for a variety of tasks such as cleaning, mopping, and applying floor finish, for example. The user benefits from a better, easier to use cleaning device 10, a more efficient cleaning device 10, the flexibility to utilize the floor solution of choice, and the opportunity to use the cleaning device 10 in any environment for a project of any size.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A modular cleaning device comprising:

a handle assembly including a container, a dispensing element, a cleaning element, a push-button actuator disposed at one end of the handle assembly, a rod disposed in the handle assembly, and a valve disposed in the handle assembly operably engaging an end of the rod, the valve including a piston normally urged to cover an opening formed within the handle assembly providing fluid communication between the container and the dispensing element, the push-button actuator configured to urge the piston away from the opening of the handle assembly to provide fluid communication between the container and the dispensing element when the push-button actuator is pressed in an axial direction of the rod; and a backpack including a bladder in fluid communication with the dispensing element;

wherein the handle assembly is configured to selectively dispense a fluid from at least one of the backpack and the container; wherein when the push-button actuator is pressed in the axial direction of the rod for a first time the piston is urged away from the opening of the handle assembly and fluid continuously flows from the one of the container and the bladder, through the opening of the handle assembly, and out the dispensing element, and wherein when the push-button actuator is pressed in the axial direction of the rod a second time the piston of the valve returns to a position covering the opening of the handle assembly thereby preventing the fluid from flowing through the opening of the handle assembly and out the dispensing element.

2. The modular cleaning device of claim 1, wherein the bladder is in fluid communication with at least one of the container and an adaptor in fluid communication with the dispensing element.

3. The modular cleaning device of claim 1, wherein the cleaning element is removeably connected to a frame disposed at an end of the handle assembly.

4. The modular cleaning device of claim 1, wherein the cleaning element is at least one of configured for dusting, configured for damp mopping, configured for deep cleaning, disposable, configured for use with a floor finish application, configured for use with a staining application, and configured for use on concrete, and wherein the cleaning element is interchangeable with additional cleaning elements.

5. The modular cleaning device of claim 1, wherein when pressed the first time, a pressure is applied to the push-button actuator in a direction toward the rod until the valve reaches a locked-on position, wherein the pressure applied to the push-button actuator can be ceased while the valve maintains the locked-on position, wherein the fluid can flow continuously out of the dispensing element when in the locked-on position.

6. The modular cleaning device of claim 5, wherein when pressed the second time, a pressure is applied to the push-button actuator in the direction toward the rod until the valve is released from the locked-on position causing the flow of fluid through the dispensing element to be stopped.

7. The modular cleaning device of claim 1, wherein the first time the push-button actuator is pressed and the second time the push-button actuator is pressed, pressure is applied to the push-button actuator in the same direction toward the rod.

8. A modular cleaning device comprising:

a handle including a push-button actuator disposed at a first end and a frame removeably connected to a second end, a rod disposed in the handle, and a valve disposed in the handle operably engaging an end of the rod, the valve including a piston normally urged to cover an opening formed within the handle;

a dispensing element configured to selectively dispense fluid from a user-wearable backpack and a container disposed on the handle, the opening of the handle providing fluid communication between the dispensing element and each of the backpack and the container; and a cleaning element removeably connected to the frame, the push-button actuator configured to urge the piston away from the opening of the handle to provide fluid communication between at least one of the backpack and the dispensing element and the container and the dispensing element when the push-button actuator is pressed in an axial direction of the rod, wherein when the push-button actuator is pressed in the axial direction of the rod for a first time the piston is urged away from the opening of the handle and fluid continuously flows from one of the container and the backpack, through the opening of the handle, and out the dispensing element, and wherein when the push-button actuator is pressed in the axial direction of the rod for a second time the piston of the valve returns to a position covering the opening of the handle thereby preventing the fluid from flowing through the opening of the handle and out the dispensing element.

9. The modular cleaning device of claim 8, wherein the cleaning element is at least one of configured for dusting, configured for damp mopping, configured for deep cleaning, disposable, configured for use with a floor finish application, configured for use with a staining application, and configured for use on concrete, and wherein the cleaning element is interchangeable with additional cleaning elements.

10. The modular cleaning device of claim 8, wherein the container is removeably connected to the handle.

11. A modular cleaning device comprising:

a bladder disposed in a backpack;

a handle assembly including a dispensing element, a push-button actuator disposed at one end of the handle assembly, a rod disposed in the handle assembly, and a valve disposed in the handle assembly operably engaging an end of the rod, the valve including a piston normally urged to cover an opening formed within the handle assembly;

a conduit providing fluid communication between the bladder and the opening of the handle assembly, the opening in of the handle assembly providing fluid communication between the conduit and the dispensing element and the push-button actuator configured to cause the rod to urge the piston away from the opening of the handle assembly to allow a fluid to flow from the bladder and out of the dispensing element when the push-button actuator is pressed in an axial direction of the rod; and a belt removeably attached to the backpack for encircling a waist of a user;

wherein when the push-button actuator is pressed in the axial direction of the rod for a first time the piston is urged away from the opening of the handle assembly and fluid continuously flows from the bladder, through the conduit and the opening of the handle assembly, and out the dispensing element, and wherein when the push-button actuator is pressed in the axial direction of the rod for a second time the piston returns to a position covering the opening of the handle assembly thereby preventing the fluid from flowing through the opening of the handle assembly and out the dispensing element.

12. The modular cleaning device of claim 11, wherein the conduit is fluidly connected to a fluid container disposed on the handle assembly.

13. The modular cleaning device of claim 11, wherein the modular cleaning device is configured to selectively dispense a fluid from one of the bladder of the backpack and a fluid container disposed on the handle assembly.

14. The modular cleaning device of claim 11, wherein at least one of the backpack and the belt include one or more removeable compartments for storing one or more cleaning elements.

* * * * *